United States Patent [19]

Johnson, Jr.

[11] 3,938,844

[45] Feb. 17, 1976

[54] ADJUSTABLE PELICAN HOOK

[75] Inventor: Curtiss S. Johnson, Jr., Middle Haddam, Conn.

[73] Assignee: C. Sherman Johnson Co., Inc., East Haddam, Conn.

[22] Filed: June 10, 1974

[21] Appl. No.: 478,077

[52] U.S. Cl. ..... 294/83 R; 24/68 CT

[51] Int. Cl.[2] ..... B66C 1/36

[58] Field of Search ..... 294/78 R, 82 R, 83 R, 84; 24/68 CT, 68 D, 230.5 CR, 230.5 SS, 232, 241 PP, 241 SB, DIG. 20, DIG. 21; 254/54, 67, 83, 98, 100; 403/43, 44, 45, 48, 60

[56] References Cited

UNITED STATES PATENTS

| | | | |
|---|---|---|---|
| 518,452 | 4/1894 | Holden | 294/83 R |
| 839,036 | 12/1906 | Roberts | 294/83 R |
| 1,498,239 | 6/1924 | Hudgins | 294/83 R |
| 2,040,790 | 5/1936 | Kaufmann | 24/68 CT X |
| 2,050,495 | 8/1936 | Maynard | 24/68 CT X |
| 2,422,916 | 6/1947 | MacCluney | 294/83 R |
| 2,534,619 | 12/1950 | Niemi | 294/83 R |
| 2,927,358 | 3/1960 | Ratcliff | 294/82 R X |
| 3,390,706 | 7/1968 | Hayden | 403/60 X |

*Primary Examiner*—James B. Marbert
*Assistant Examiner*—Johnny D. Cherry
*Attorney, Agent, or Firm*—McCormick, Paulding & Huber

[57] ABSTRACT

A pelican hook of the type utilized to make rapid and secure connections with cables, chains and eyelets is provided with adjustment features permitting the distance between or tension applied to the connected articles to be varied. The hook is designed to permit the distance or tension adjustment to be made while the articles are interconnected by the hook. Additional safety features prevent the hook from opening until it is manually released.

4 Claims, 3 Drawing Figures

ADJUSTABLE PELICAN HOOK

BACKGROUND OF THE INVENTION

The present invention relates to pelican hooks of the type which are used to make rapid connections and disconnections between cables, chains and the like. More particularly, the present invention relates to an adjustable pelican hook which permits the tension in connected cables or chains or the distance between two connected points to be varied while the hook is closed and connected to the points.

Pelican hooks are well known in the art. Examples of patents disclosing such hooks are: U.S. Pats. 827,795, 2,513,245 and 3,615,116. Such hooks are employed in situations where a rapid and simple release mechanism is needed to couple and uncouple two or more articles.

Pelican hooks generally include two rather elongated and pivotally connected members, one of which sometimes resembles the curvature of a pelican's lower mandible from which the name is derived. To engage the hook, the one elongated member or jaw resembling the shape of a pelican's mandible is laced through or placed around an article being attached and then is pivoted into a locking position with the other elongated member generally forming the body of the hook to capture the attached article. A ring or other catch mounted on the body holds the jaw in the closed position.

In pelican hooks of the prior art, it was not possible to adjust the tension with which the hook pulled the attached articles together or the distance between the attached articles while the pelican hook was closed. Any adjustment permitted by the hook was made only while the hook was open and, therefore, establishing the correct tension or distance between attached articles was a trial-and-error process.

It is, accordingly, a general object of the present invention to disclose a pelican hook having features permitting it to be adjusted while the hook is in the closed condition.

SUMMARY OF THE INVENTION

The present invention resides in a pelican hook having adjustment features. The hook includes a body member and a releasable jaw member pivotally connected to the body member for movement between opened and closed positions. The body member in one light-weight form is comprised of a folded metal plate resembling a shell structure. A catch is also connected to the body member and cooperates with the jaw member for locking the jaw member in the closed position.

Adjustment of the pelican hook is achieved primarily by an adjustable link supported on the body member and means for adjusting the position in which the link is supported. The link includes a fastening at one end for connecting the pelican hook to another article, and the means for adjusting the link increases or decreases the distance between the fastening and the jaw member in the closed position. In a preferred form of the invention, the adjustable link includes a threaded shaft and the means for adjusting includes a rotatable nut which moves the shaft back and forth relative to the body member.

Further means are provided to prevent the threaded shaft from rotating relative to the body so that rotation of the nut insures movement of the nut along the threaded shaft and, correspondingly, movement of the shaft relative to the body member. Adjustment of the shaft shortens or lengthens the overall distance of the pelican hook and produces a corresponding change in position of the attached articles. Such a change in position may also cause tension to be applied to a cable or chain to which the hook is joined or attached.

Other safety features include means, such as a detent, for holding the catch in locking engagement with the jaw member until the hook is manually opened.

DESCRIPTION OF THE PREFERRED EMBODIMENTS

Figure 2:
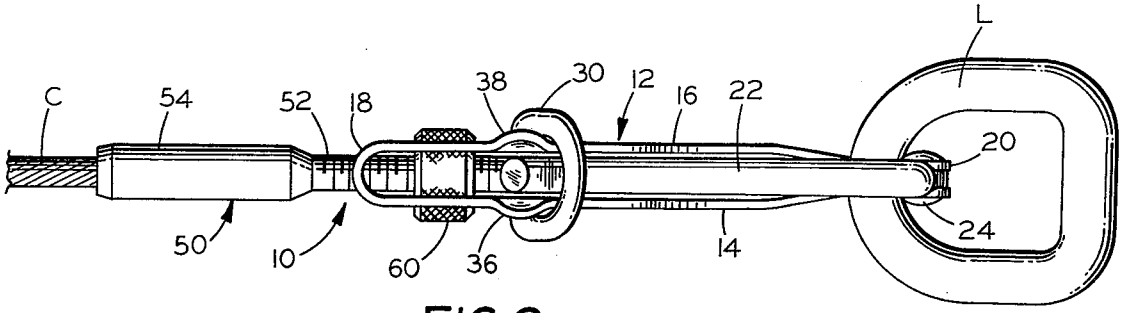
FIG. 2 is a top plan view of the pelican hook in FIG. 1.
Figure 1:
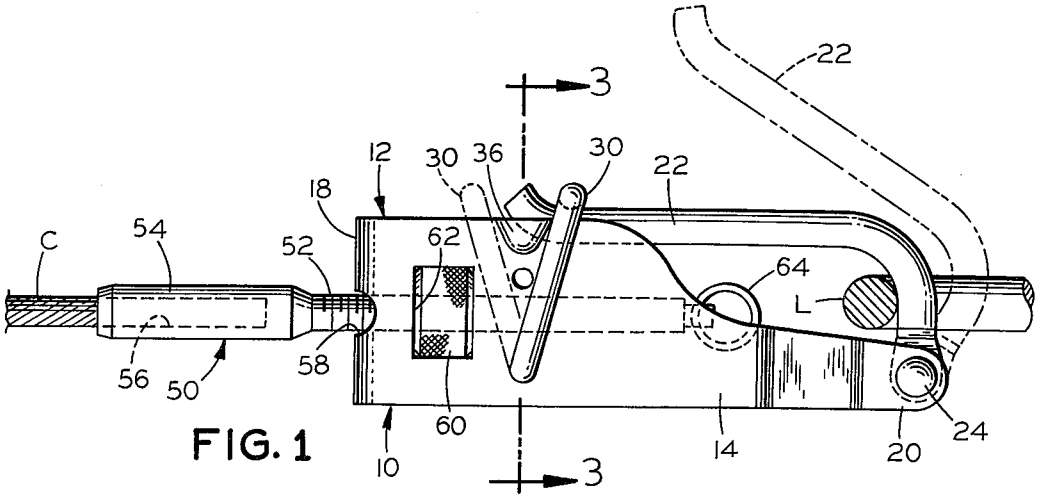
FIG. 1 is a horizontal elevation view of the pelican hook in accordance with one embodiment of the present invention.

FIGS. 1 and 2 illustrate one embodiment of a pelican hook having an adjustment feature in accordance with the present invention. The hook, generally designated 10, includes an elongated shell body member 12 to which the remaining components of the hook are attached. The body member 12 is formed preferably by a metal plate which is folded into a U-shaped configuration seen most clearly in FIG. 2. In this configuration, two elongated sides 14 and 16 extend longitudinally along the hook between the bent or folded end 18 and an open end 20.

A jaw 22 is pivotally connected to the open end 20 of the body member 12 by means of a pin 24. The jaw pivots relative to the body member between the closed position illustrated and the open position shown in phantom. The jaw also has a curved configuration so that in the closed position a space is provided between the body member 12 and the jaw to accommodate a link L, an eyelet or other object to which the hook 10 attaches.

Figure 3:
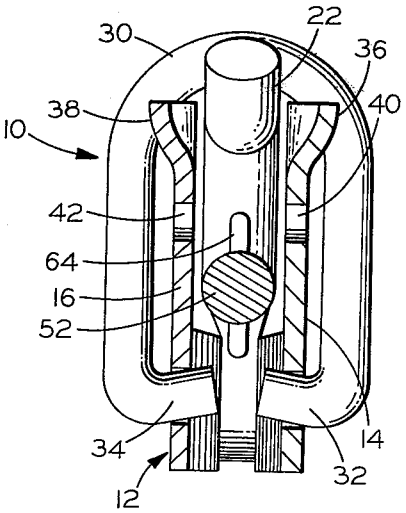
FIG. 3 is a cross sectional view of the pelican hook as viewed along the sectioning line 3—3 in FIG. 1.

A catch 30 formed by a split ring seen most clearly in FIG. 3 is attached to the body member 12 and cooperates with the free end of the jaw to lock the jaw in the closed position illustrated. Two ears 32 and 34 on the ends of the ring forming the catch 30 project through apertures in the respective sides 14 and 16 of the body member and permit the catch to be pivoted relative to the free end of the jaw between a locking position illustrated and an unlocked position shown in phantom in FIG. 1.

A detent holding the catch 30 in both the locked and unlocked positions is formed by a pair of dimples 36 and 38 in the sides 14 and 16 respectively of the body member 12. The width of the dimples at the upper extremities of the sides 14 and 16 is slightly greater than the corresponding width of the catch 30; however, the flexing of the sides 14 and 16 allows the dimples 36 and 38 to shift slightly inwardly as the catch is pivoted over the dimples between the locking and unlocking positions. It will be understood that the curved, free end of the jaw 22 captured by the catch 30 holds the catch in the locking position as long as tension is applied to the pelican hook by the link L. However, the detent formed by the dimples 36 and 38 assures positive locking of the jaw 22 by the catch 30 even in the absence of applied tension and, hence, the detent is a safety device preventing inadvertent opening of the hook. At the same time, manual operation of the catch and jaw is executed with substantial freedom.

As a further safety feature, aligned apertures 40 and 42 in the sides 14 and 16 respectively are provided to accommodate a lock pin (not shown) for positively holding the catch 30 in the locked position. The apertures 40 and 42, however, would only be utilized in situations where the pelican hook 10 is to be held in the closed condition for extended periods of time and where there is sufficient danger of the hook being opened by a child or other means at an inappropriate time.

In accordance with the present invention, an adjustable link 50 including a threaded shaft 52 is supported on the body member 12 adjacent the folded end 18. The link 50 has a fastening 54 to which a cable C or other article may be connected so that the link L and the cable C can be joined together by the hook 10. The fastening 54 illustrated includes a bore 56 into which the cable C is inserted and captured by swaging the end of the fastening.

The threaded shaft 52 extends through an aperture 58 in the folded end 18 of the body member 12 and extends longitudinally through the pelican hook between the sides 14 and 16. A knurled adjusting nut 60 at the side of the aperture opposite the fastening 54 is threadably engaged with the shaft 52 and is captured within two cut-outs 62 in the respective sides 14 and 16 of the body member. The cut-outs 62 define a longitudinal reference station in the body member against which the nut 60 is pulled by the adjusting link 50. The end of the shaft 52 adjacent the pivoted jaw 22 contains an aperture through which a retention ring 64 is laced to limit the rotation of the shaft relative to the body member 12. Accordingly, rotation of the adjusting nut 60 will increase or decrease the distance between the fastening 54 on the adjusting link and the pivoted jaw 22 to permit the overall dimensions of the pelican hook 10 in the closed condition to be adjusted and to thereby vary the tension that might be applied, for example, to the cable C to which the hook is attached. The ring 64 also prevents the adjusting nut 60 from being unscrewed entirely from the threaded shaft 54 which would allow the link 50 to be pulled through the aperture 58 and thus separate the cable C and the link L. The ring 64, therefore, aids the function of adjusting the hook without opening the jaw 22 and performs a safety function by preventing the hook from separating during adjustment.

From the above, it is apparent that the pelican hook 10 is adjustable while it is closed and performing a joining function. Also, the hook possesses a number of safety features preventing the hook from either separating or opening while it is performing the joining function.

While the present invention has been defined in a preferred embodiment, it should be understood that still other modifications and substitutions can be had without departing from the spirit of the invention. For example, the jaw 22 may take different shapes than that illustrated and correspondingly, the body member 12 may be changed in form and structure as long as there is a space between the jaw and body member for accommodating the link or other article to which the hook 10 attaches. The fastening 54 on the end of the adjusting link may take other forms for connecting the hook to items other than the cable C. The catch 30 can also be varied in shape and the detent formed by the dimples 36 and 38 can be replaced by a ball detent, a spring or other device for holding the catch 30 in the locking position. The limiting ring 64 can also be replaced by other members such as a slide block fixed to the shaft 52 and filling the space between the sides 14 and 16 so that it would serve as a stop preventing the shaft 52 from rotating between the sides 14 and 16 and also preventing the knurled nut 60 from being threadably disengaged from the shaft. Accordingly, the present invention has been described in a preferred embodiment by way of illustration rather than limitation.

I claim:

1. A pelican hook having an adjustment feature comprising:

an elongated U-shaped body member having generally parallel sides connected together at one end and a opening between the sides at the other end;

a jaw member pivotally connected to the body member between the sides at the other end for movement between opened and closed positions;

a catch formed from a ring pivotally mounted in the body member to move into locking engagement with the jaw member in the closed position;

means for holding the catch in locking engagement with the jaw member including a detent mounted on the body member;

an adjustable link including a threaded shaft extending through the body member at the one end and between the sides adjacent the one end, the link also having a fastening for connecting the pelican hook to another article;

means for adjusting the position of the link relative to the body member to increase and decrease the distance between the fastening on the adjustable link and the jaw member in the closed position, the adjusting means including a rotatable nut on the threaded shaft and captured by the parallel sides of the body member at a longitudinal station on the body member; and means for limiting the rotation of the threaded shaft relative to the body member, the limiting means including a member extending transversely through the threaded shaft and between the parallel sides of the body member.

2. A pelican hook as defined in claim 1 wherein the one end of the threaded shaft between the parallel sides of the body member has a transverse aperture; and the means for limiting comprises a retention member laced through the aperture in the threaded shaft.

3. A pelican hook as defined in claim 2 wherein the rotatable nut is mounted on the threaded shaft between the one end of the body member and the retention member whereby the retention member prevents the rotatable nut from being rotated off of the threaded shaft.

4. A pelican hook as defined in claim 1 wherein:

the U-shaped body member is a shell body comprised by a folded metal plate having an aperture accommodating the threaded shaft at the one end, and cutouts in the parallel sides accommodating the rotatable nut on the threaded shaft to capture the nut at the longitudinal station on the body member.

* * * * *